US005956866A

United States Patent [19]

Spears

[11] Patent Number: 5,956,866

[45] Date of Patent: Sep. 28, 1999

[54] FOOTWEAR WITH HEATED SOLE

[76] Inventor: James R. Spears, 145-04 182nd St., Springfield Gardens, N.Y. 11413

[21] Appl. No.: 08/992,564

[22] Filed: Dec. 17, 1997

[51] Int. Cl.[6] ..... A43B 7/02; A43B 23/00

[52] U.S. Cl. ..... 36/2.6; 36/136

[58] Field of Search ..... 36/136, 2.6, 132, 36/35 R, 34 R

[56] References Cited

U.S. PATENT DOCUMENTS

| | | | |
|---|---|---|---|
| 2,507,991 | 5/1950 | Neal | 36/136 X |
| 2,897,609 | 8/1959 | Bodkin | 36/136 X |
| 3,977,093 | 8/1976 | Santroch | 36/2.6 |
| 4,798,933 | 1/1989 | Annovi | 36/2.6 X |
| 4,910,881 | 3/1990 | Baggio et al. | 36/2.6 |
| 5,063,690 | 11/1991 | Slenker | 36/2.6 |
| 5,623,772 | 4/1997 | Sunderland et al. | 36/2.6 |

FOREIGN PATENT DOCUMENTS

| | | | |
|---|---|---|---|
| 2365973 | 6/1978 | France | 36/2.6 |
| 2469886 | 6/1981 | France | 36/2.6 |

*Primary Examiner*—B. Dayoan

[57] ABSTRACT

A new footwear, such as a shoe or boot, with heated sole for helping keep a wearer's foot warm, especially in cold weather. The inventive device includes a footwear member having a sole and an upper portion for accepting a foot. The heel of the sole has a cavity therein with the lower surface of the heel having an opening into the cavity. A heel door is pivotally coupled to the lower surface of the heel for substantially closing the opening into the cavity. An elongate heating coil is provided within the interior of the sole for providing heat to the footwear when powered. Disposed within the cavity of the heel is a power source electrically coupled to the heating coil to provide power to the heating coil.

11 Claims, 2 Drawing Sheets

FOOTWEAR WITH HEATED SOLE

BACKGROUND OF THE INVENTION

1. Field of the Invention

The present invention relates to heating devices for footwear and more particularly pertains to a new footwear, such as a shoe or boot, with heated sole for helping keep a wearer's foot warm, especially in cold weather.

2. Description of the Prior Art

The use of heating devices for footwear is known in the prior art. More specifically, heating devices for footwear heretofore devised and utilized are known to consist basically of familiar, expected and obvious structural configurations, notwithstanding the myriad of designs encompassed by the crowded prior art which have been developed for the fulfillment of countless objectives and requirements.

Known prior art heating devices for footwear include U.S. Pat. No. 4,910,881; U.S. Pat. No. 5,062,222; U.S. Pat. No. Des. 332,519; U.S. Pat. No. 5,230,170; U.S. Pat. No. 5,331,688; and U.S. Pat. No. 4,756,095.

While these devices fulfill their respective, particular objectives and requirements, the aforementioned patents do not disclose a new footwear with heated sole. The inventive device includes a footwear member having a sole and an upper portion for accepting a foot. The heel of the sole has a cavity therein with the lower surface of the heel having an opening into the cavity. A heel door is pivotally coupled to the lower surface of the heel for substantially closing the opening into the cavity. An elongate heating coil is provided within the interior of the sole for providing heat to the footwear when powered. Disposed within the cavity of the heel is a power source electrically coupled to the heating coil to provide power to the heating coil.

In these respects, the footwear with heated sole according to the present invention substantially departs from the conventional concepts and designs of the prior art, and in so doing provides an apparatus primarily developed for the purpose of helping keep a wearer's foot warm, especially in cold weather.

SUMMARY OF THE INVENTION

In view of the foregoing disadvantages inherent in the known types of heating devices for footwear now present in the prior art, the present invention provides a new footwear with heated sole construction wherein the same can be utilized for helping keep a wearer's foot warm, especially in cold weather.

The general purpose of the present invention, which will be described subsequently in greater detail, is to provide a new footwear with heated sole apparatus and method which has many of the advantages of the heating devices for footwear mentioned heretofore and many novel features that result in a new footwear with heated sole which is not anticipated, rendered obvious, suggested, or even implied by any of the prior art heating devices for footwear, either alone or in any combination thereof.

To attain this, the present invention generally comprises a footwear member having a sole and an upper portion for accepting a foot. The heel of the sole has a cavity therein with the lower surface of the heel having an opening into the cavity. A heel door is pivotally coupled to the lower surface of the heel for substantially closing the opening into the cavity. An elongate heating coil is provided within the interior of the sole for providing heat to the footwear when powered. Disposed within the cavity of the heel is a power source electrically coupled to the heating coil to provide power to the heating coil.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new footwear with heated sole apparatus and method which has many of the advantages of the heating devices for footwear mentioned heretofore and many novel features that result in a new footwear with heated sole which is not anticipated, rendered obvious, suggested, or even implied by any of the prior art heating devices for footwear, either alone or in any combination thereof.

It is another object of the present invention to provide a new footwear with heated sole which may be easily and efficiently manufactured and marketed.

It is a further object of the present invention to provide a new footwear with heated sole which is of a durable and reliable construction.

An even further object of the present invention is to provide a new footwear with heated sole which is susceptible of a low cost of manufacture with regard to both materials and labor, and which accordingly is then susceptible of low prices of sale to the consuming public, thereby making such footwear with heated sole economically available to the buying public.

Still yet another object of the present invention is to provide a new footwear with heated sole which provides in the apparatuses and methods of the prior art some of the advantages thereof, while simultaneously overcoming some of the disadvantages normally associated therewith.

Still another object of the present invention is to provide a new footwear with heated sole for helping keep a wearer's foot warm, especially in cold weather.

Yet another object of the present invention is to provide a new footwear with heated sole which includes a footwear member having a sole and an upper portion for accepting a foot. The heel of the sole has a cavity therein with the lower surface of the heel having an opening into the cavity. A heel door is pivotally coupled to the lower surface of the heel for substantially closing the opening into the cavity. An elongate heating coil is provided within the interior of the sole for providing heat to the footwear when powered. Disposed within the cavity of the heel is a power source electrically coupled to the heating coil to provide power to the heating coil.

Still yet another object of the present invention is to provide a new footwear with heated sole that includes a removable battery power source within the heel of the sole for providing easy and convenient replacement of the battery.

Even still another object of the present invention is to provide a new footwear with heated sole that allows a wearer to continue their activities, whether work or recreational, while still keeping their feet warm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
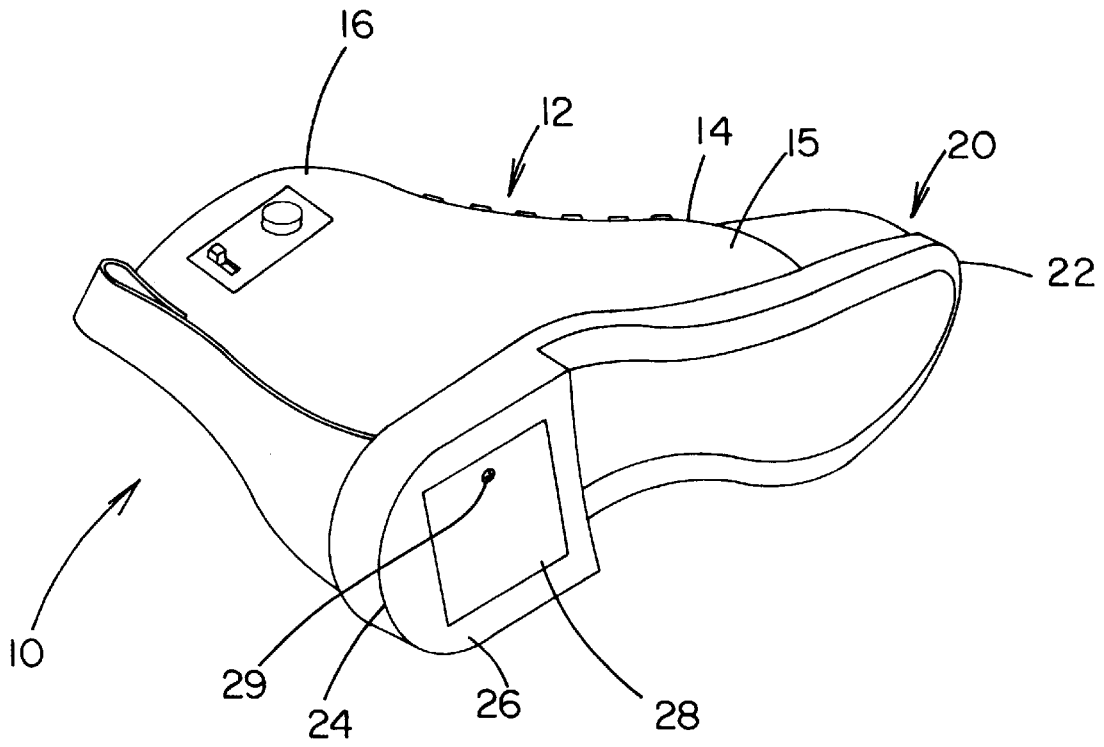
FIG. 1 is a schematic perspective view of a new footwear with heated sole according to the present invention.

With reference now to the drawings, and in particular to FIGS. 1 through 4 thereof, a new footwear with heated sole embodying the principles and concepts of the present invention and generally designated by the reference numeral 10 will be described.

As best illustrated in FIGS. 1 through 4, the footwear with heated sole 10 generally comprises a footwear member 12 having a sole 20 and an upper portion 14 for accepting a foot. The heel 24 of the sole 20 has a cavity therein with the lower surface 26 of the heel 20 having an opening into the cavity 25. A heel door 28 is pivotally coupled to the lower surface 26 of the heel 20 for substantially closing the opening into the cavity 25. An elongate heating coil 30 is provided within the interior of the sole 20 for providing heat to the footwear 10 when powered. Disposed within the cavity 25 of the heel 20 is a power source 40 electrically coupled to the heating coil 30 to provide power to the heating coil 30.

Figure 2:
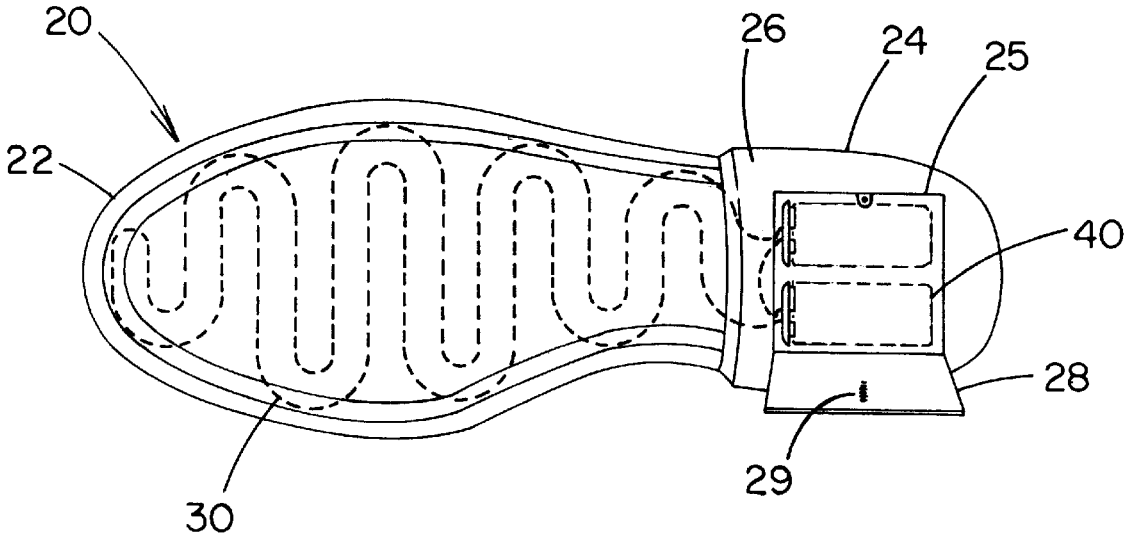
FIG. 2 is a schematic bottom side view of the sole of the present invention.
Figure 3:
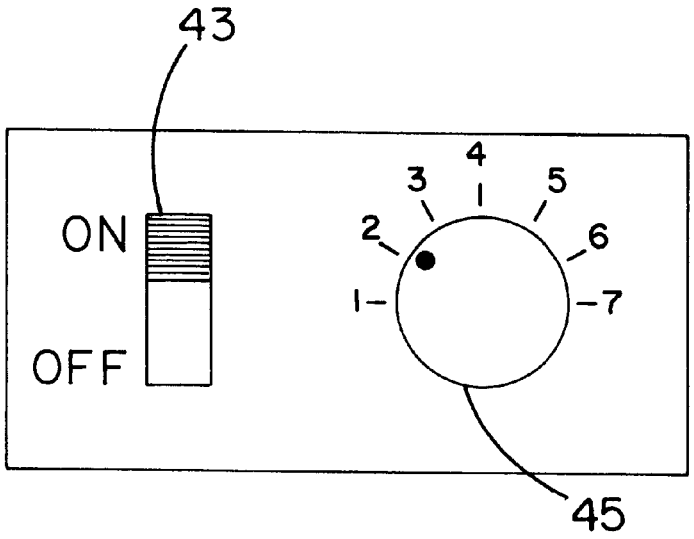
FIG. 3 is a schematic side view of the switch actuator and the temperature selection actuator of the present invention.
Figure 4:
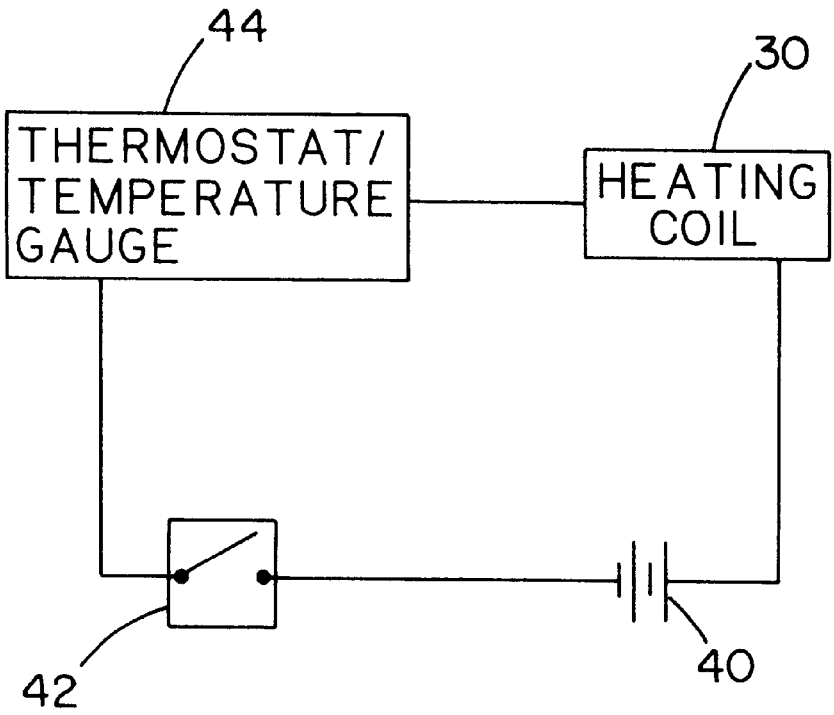
FIG. 4 is a schematic electrical wiring diagram of the heating system of the present invention.

The heated footwear device 10 may be constructed in various types of footwear members 12, such as a shoe or a boot with a sole 20 and an upper portion 14 fashioned for accepting a foot therein. Preferably, the footwear member 12 is a boot, as shown in FIG. 1, with the upper portion 14 of the footwear member having a foot section 15 and an shaft section 16 extending upwards from the foot section 15 and located towards the heel 24 of the sole 20. As illustrated in FIG. 2, the sole 20 has a toe end 22 opposite a heel 20. The heel 20 includes a cavity 25 therein with an opening through the lower surface 26 of the heel 20 into the cavity 25. Preferably, the cavity 25 and opening are generally rectangular in shape to aid the fitting of batteries 40 therein.

The opening of the lower surface 26 of the heel 20 into the cavity 25 is substantially closable by a preferably rectangular heel door 28 pivotally coupled to the lower surface 26. The heel door 28 is pivotable between open (FIG. 1) and closed positions (FIG. 2) such that the heel door 28 substantially closes the opening into the cavity 25 when in the closed position. Ideally, a holding means 29, such as releasable threaded fastener, is provided for releasably holding the heel door 28 in the closed position to insure substantial closing of the opening into the cavity 25 while the boot 10 is being worn by a user.

With reference to FIG. 2, the elongate heating coil 30 is provided within the interior of the sole 20. The heating coil 20 provides heat when powered to the interior of the upper portion 14 of the footwear member 10 to help keep a wearer's foot warm while the boot 10 is worn. Preferably, the heating coil 20 is arranged in a serpentine arrangement (e.g. a plurality of connected S-shaped portions) between the toe end 22 of the sole 20 and the heel 24 of the sole 20. Ideally, the heating coil 20 is arranged so the S-portions of the serpentine arrangement extend laterally between the sides of the sole 20.

The heating coil 20 is powered by a power source 40 disposed within the cavity 25 of the heel 20. The power source 40 is electrically coupled to the heating coil 30 to provide power to the heating coil 20 for providing heat therefrom. Preferably, the power source is a battery disposed within the cavity 25. Preferably, a switch 42 is electrically coupled to the heating coil 30 for selectively controlling the powering of the heating coil 30. Ideally, the switch 42 includes a switch actuator 43 provided on the upper portion 14 of the footwear member 12, preferably on the shaft section 16. Also in the preferred embodiment, a temperature controller 44 is electrically coupled to the heating coil 30 for controlling the amount of heat provided by the heating coil 20 when powered. Preferably, the temperature controller 44 includes a temperature selection actuator 45 provided on the shaft section 16 of the footwear member 12 for selectively controlling the amount of heat provided by the heating coil 30. Illustratively, in use, the temperature selection actuator 45 may be rotated between different settings or levels for the amount of heat provided by the heating coil 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated footwear device, comprising:

a footwear member having a sole and an upper portion for accepting a foot;

said sole having an interior, a toe end, a heel, and a pair of sides defining a sole width therebetween;

said heel of said sole having a lower surface, and a cavity therein, said lower surface of said heel having an opening into said cavity of said heel;

a heel door for substantially closing said opening of said lower surface of said heel, said heel door being pivotally coupled to said lower surface of said heel;

an elongate heating coil being provided within said interior of said sole, said heating coil providing heat when powered, said heating coil comprising a pair of conductor segments arranged substantially parallel and substantially equidistant with respect to each other, said conductor segments being arranged in a serpentine arrangement between said toe end of said sole and said heel of said sole;

said heating coil having a plurality of alternating bend portions and straight portions, said straight portions extending between said bend portions, said bend portions being positioned towards said sides of said sole, said straight portions extending between said sides of said sole more than one half of said sole width; and a power source being disposed within said cavity of said heel, said power source being electrically coupled to said heating coil, said power source providing power to said heating coil.

2. The device of claim 1, further comprising a switch being electrically coupled to said heating coil.

3. The device of claim 2, wherein said switch includes a switch actuator being provided on said upper portion of said footwear member.

4. The device of claim 1, further comprising a temperature controller for controlling the amount of heat provided by said heating coil, said temperature controller being electrically coupled to said heating coil.

5. The device of claim 4, wherein said temperature controller has a temperature selection actuator for selectively controlling the amount of heat provided by said heating coil, said temperature selection actuator being provided on said footwear member.

6. The device of claim 1, further comprising holding means for releasably holding said heel door in a closed position substantially closing said opening of said lower surface of said heel, wherein said holding means comprises a threaded fastener for providing a secure closing of the heel door.

7. The device of claim 1, wherein said heating coil is arranged in a serpentine arrangement between said toe end of said sole and said heel of said sole.

8. The device of claim 1, wherein said power source is a battery.

9. The device of claim 5, wherein said temperature selection actuator is round for preventing inadvertent movement of the temperature selection actuator.

10. The device of claim 1, wherein said heating coil has a plurality of alternating bend portions and straight portions, said bend portions being positioned towards said sides of said sole, said straight portions extending between said bend portions, said straight portions extending substantially the distance between said sides of said sole.

11. A heated footwear device, comprising:

a footwear member having a sole and upper portion for accepting a foot;

said sole having an interior, a toe end, a heel, and a pair of sides;

said heel of said sole having a lower surface, and a cavity therein, said lower surface of said heel having an opening into said cavity of said heel;

a heel door for substantially closing said opening of said lower surface of said heel, said heel door being pivotally coupled to said lower surface of said heel;

holding means for releasably holding said heel door in a closed position substantially closing said opening of said lower surface of said heel, wherein said holding means comprises a threaded fastener for providing a secure closing of the heel door;

an elongate heating coil being provided within said interior of said sole, said heating coil comprising a pair of conductor segments arranged substantially parallel and substantially equidistant with respect to each other, said conductor segments being arranged in a serpentine arrangement between said toe end of said sole and said heel of said sole, said conductor segments being arranged in a serpentine arrangement between said toe end of said sole and said heel of said sole, said heating coil providing heat when powered;

wherein the heating coil has a plurality of alternating bend portions and straight portions, said bend portions being positioned towards said sides of said sole, said straight portions extending between said bend portions, said straight portions extending substantially the distance between said sides of said sole;

a power source being disposed within said cavity of said heel, said power source being electrically coupled to said heating coil, said power source providing power to said heating coil, wherein said power source includes a battery;

a switch being electrically coupled to said heating coil, said switch including a switch actuator being provided on one side of said upper portion of said footwear member; and a temperature controller for controlling the amount of heat provided by said heating coil, said temperature controller being electrically coupled to said heating coil, said temperature controller having a rotatable temperature selection actuator for selectively controlling the amount of heat provided by said heating coil, said temperature selection actuator being round for preventing inadvertent movement of the temperature selection actuator, said temperature selection actuator being provided on one side of said upper portion of said footwear member.

* * * * *